US006740800B1

(12) United States Patent
Cunningham

(10) Patent No.: US 6,740,800 B1
(45) Date of Patent: May 25, 2004

(54) PORTABLE KEYBOARD TREMOLO MUSICAL INSTRUMENT

(76) Inventor: Robert Felder Cunningham, 446 Clifton Rd. NE., Atlanta, GA (US) 30307

( * ) Notice: Subject to any disclaimer, the term of this patent is extended or adjusted under 35 U.S.C. 154(b) by 0 days.

(21) Appl. No.: 10/366,243

(22) Filed: Feb. 13, 2003

(51) Int. Cl.[7] ..... G10D 13/02
(52) U.S. Cl. ..... 84/423; 84/424
(58) Field of Search ..... 84/423 R, 267, 84/424, 290, 291, 425, 430, 431, 441, 453, 454, 455

(56) References Cited

U.S. PATENT DOCUMENTS 1,044,553 A 11/1912 Marx
4,744,280 A * 5/1988 Garritano ..... 84/726
5,691,490 A * 11/1997 Williams ..... 84/170
5,747,711 A * 5/1998 Cavaness et al. ..... 84/291

* cited by examiner

*Primary Examiner*—Kimberly Lockett

(57) ABSTRACT

A portable instrument with strings hammered by strikers operated by keys of a chromatic keyboard is described. The unique tremolo sounding of the strings is sensitively controllable by a players's touch on the keys as well as by manipulation of the instrument during play while holding the instrument by means of shoulder strap, the player standing or walking.

11 Claims, 2 Drawing Sheets

PORTABLE KEYBOARD TREMOLO MUSICAL INSTRUMENT

FIELD OF THE INVENTION

This invention relates generally to the field of musical instruments, particularly keyboard stringed instruments with strings that are struck by hammers.

BACKGROUND OF THE INVENTION

The present invention is essentially novel. The instrument is carried by a shoulder strap, somewhat reminiscent of a hurdy-gurdy or accordion, and has a chromatic keyboard with strings that are sounded by hammers, similar to the action of a piano. Unlike any other instrument, the hammers are tossed by key action away from the strings whence they rebound repeatedly to produce tremolo sounds, the volume and tempo of which are sensitively controlled by the manner of pressing the keys. Also unlike any other instrument, the tilt at which the instrument is held by a player provides yet another control of tremolo volume and tempo. Hence the present invention is unique in both its manner of playing and its sound.

SUMMARY OF THE INVENTION

The object of the present invention is to disclose a portable musical instrument with a chromatic, finger-operated keyboard and hammers that strike metal strings in tremolo repetition. It is another object to describe a mechanism acting between keys and hammers whereby as much expressiveness as possible can be exercised in the playing of the instrument, i.e., a player can achieve soft or loud notes, slow or fast tremolo, and varying of a single note or phrase instantly.

These objects are realized in accord with the present invention by a light-weight, portable psaltery-type instrument, carried by a shoulder strap, having a chromatic keyboard of not much more than two octaves. A tremolo sound arises from the particular action whereby a hammer is tossed away from the string it is intended to strike whereupon a butt of the hammer impinges a spring which returns the hammer to then strike the string; the natural elasticity of the string then returns the hammer to repeat the process a number of times or until the key is released. The key operates in more than an on-off manner: The force of pressing a key determines the velocity of a hammer strike, hence the loudness; the amount of depression of a key determines the excursion of a hammer, hence the tempo of the tremolo, and the mariner of holding the instrument affects the tone, giving a net versatility that is unique.

DESCRIPTION OF A PREFERRED EMBODIMENT

Figure 1:
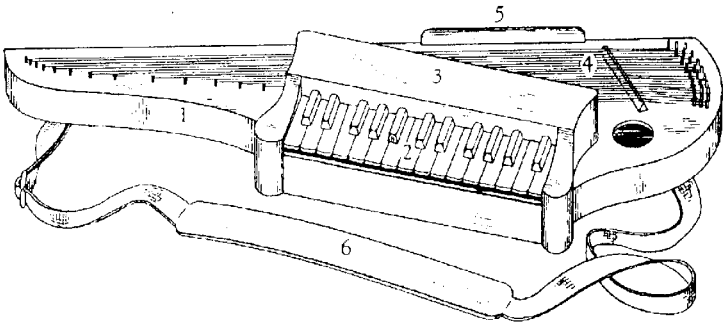
Figure 2:
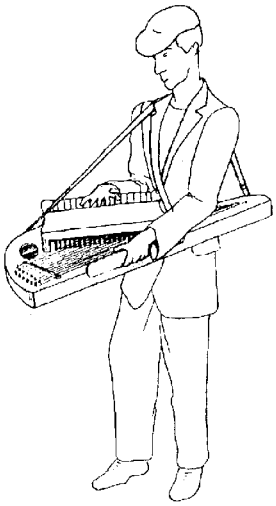

Referring to FIG. 1, a view of the instrument is shown illustrating the sounding box 1, keyboard 2, manifold 3, string bank 4, handle 5, and shoulder strap 6. A playing manner is illustrated in FIG. 2.

Figure 3:
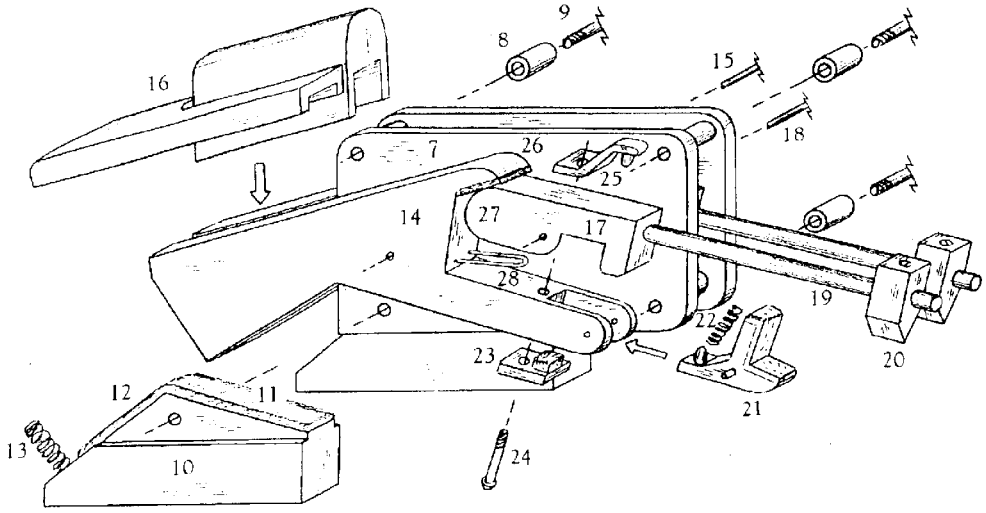

FIG. 3 is an exploded view of a key, a hammer, and connecting manifold. In particular, a manifold consists of partitions 7, spacers 8, and fasteners 9; special spacers 10 serve as stops 11 and 12 to check up and down rotations of the key and to hold a key return spring 13. A key is comprised of a wippen 14 pivotly mounted by a rod 15 through partitions 7, and a top 16 (natural or accidental) that is attached to the wippen. A hammer is comprised of a butt

17 pivotly mounted by a rod 18 through partitions 7, a metal shank 19, and a striker 20. A wippen pivotly supports hopper 21 which is tensed by spring 22 against stop 23, the latter attached to the wippen by fastener 24. Spring 22 is anchored by a clip 25, the latter attached to the wippen by fastener 24. An upper extension 26 of the wippen presses against a cam portion 27 of the butt, holding the striker above the string. Extending from the wippen is a spring 28 which stops the rotation of cam 27. In the figure, key top 16 is shown tilted 15 degrees from horizontal. This permits the instrument to be tilted somewhat either way without making the keyboard inaccessible to a player's hand. The hammer shank 19 is shown tilted 15 degrees oppositely the key top which allows a player to tilt the instrument either way to increase or to decrease the moment of gravity on the hammers.

Figure 4:
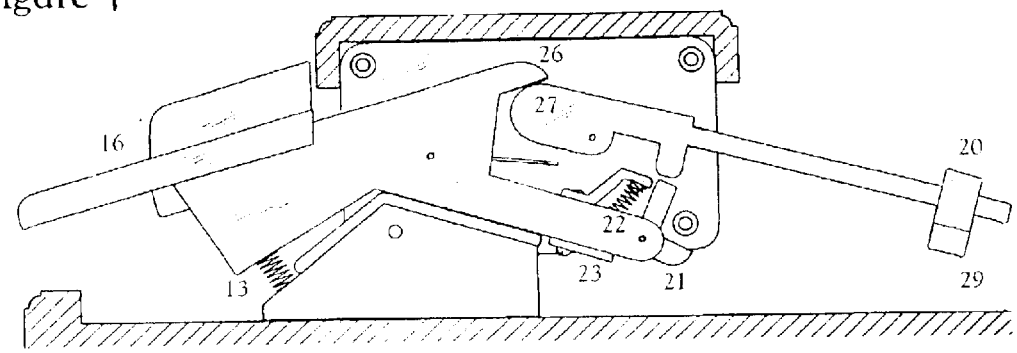

FIG. 4 shows the action at a beginning position: Key top 16 is shown in its up position, pressed upward by the force of a key return spring 13. Wippen extension 26 is shown pressed on cam 27 which prevents rotation of striker 20 down onto a string 29 when the key is not pressed down. The hopper 21 is shown held by a helical spring 22 against stop 23.

Figure 5:
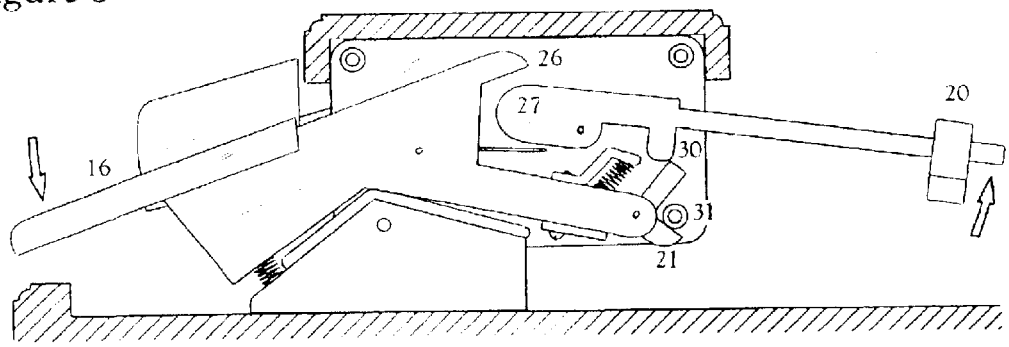

FIG. 5 shows the action in motion at an intermediate position. Key top 16 is shown partially depressed, displacing wippen extension 26 above and clear of cam 27. Raised hopper 21 presses beneath a foot extension 30 of the hammer butt, thus raising striker 20 away from the string. Manifold spacer 31 abuts the hopper to rotate it forward and clear of the foot once the foot has been tossed upward.

Figure 6:
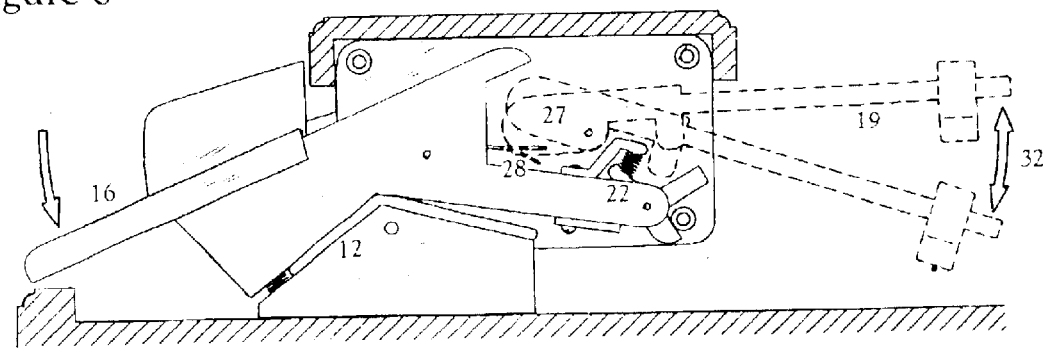

FIG. 6 shows the action in motion when key top 16 is fully depressed against stop 12. As the striker is carried by the momentum of shaft 19 after a key is pressed, cam 27 rebounds from spring 28 causing the striker to return and strike the string. The natural elasticity of the stretched music string rebounds the striker, and the process is repeated without the need to press the key again. The arc 32 traced by the striker can be larger that that shown in the figure if a player presses a key to a less extent causing spring 28 to rise by less distance; the result is a slower tremolo because of the longer arc traced by the striker. A player can sense more accurately the amount of key depression because of a second function of spring 22: As a key is depressed further, spring 22 is compressed further, thus exerting more torque on the wippen, which, of course, can be sensed at the key top 16 by a player's finger pressing the key.

While a preferred embodiment is described herein, it is understood that various modifications may be made as may fall within the scope of the invention.

What is claimed is:

1. A stringed musical instrument with finger-operable keys for playing tremolo notes, said instrument comprising:

a hollow sound box with horizontal top that supports a plurality of metal strings tuned to the chromatic scale of musical notes of a range of about two octaves, said sound box of a size that can be conveniently carried and supported by a shoulder strap in a playing position by a player;

a manifold attached by attachment means to the top of a sound box, from which manifold a plurality of finger-operable keys extend forward toward a player, and from which a plurality of hammers extend rearward to make contact near the midpoints of said strings;

an apparatus associated with each key that actuates a hammer to play tremolo notes on a string when said key is pressed down in a single downward motion by a player's finger, said apparatus enabling control of frequency of tremolo by the distance that said key is pressed;

a device associated with each key that quits the motion of a hammer when said key is released, said device stopping said hammer in a position that is a small distance over said string so that vibration of said string may continue unobstructed by contact with said hammer; and tilted mounting of said keys and of said hammers that assist a player in additionally varying the frequency of tremolo.

2. A manifold according to claim 1 comprising:

an assembly of flat partitions equal in number plus one to the number of strings on said stringed musical instrument, holes being provided in said partitions to receive pivot rods and attachment rods through said assembly;

a number of spacers of equal length provided with holes to receive said attachment rods, said spacers placed between said partitions;

said manifold comprised of said partitions, spacers, and rods all held in rigid assembly by nuts screwed onto the ends of said rods, said ends extending slightly beyond the ends of said manifold;

a plurality of hammers equal in number to the number of strings, said hammers pivotally mounted by a common pivot rod extending through holes provided in said hammers and through partitions at either side of said hammers; and a plurality of keys equal in number to the number of strings, said keys pivotally mounted by a common pivot rod extending through holes provided in said keys and through partitions at either side of said keys.

3. An apparatus according to claim 1 comprising means whereby a key pressed a partial distance downward by a player's finger causes a hammer to be tossed in an upward arc of rotation from a string.

4. An apparatus according to claim 1 further comprising means whereby a hammer which has traversed an upward arc of rotation recoils from a spring attached to a key, the length of said arc and likewise the time duration of said traversing determined by the distance that said key is pressed by a player's finger.

5. An apparatus according to claim 1 further comprising means whereby a hammer, following recoil by a spring, traverses a downward arc of rotation terminating with a strike on a string and bounce from said string to produce an audible musical note, said bounce causing said hammer to repeat an upward arc of rotation.

6. A means according to claim 3 comprising:

a key pivotally supported in a manifold, said key having a finger-operable member forward of its pivot and a hopper connected at its rearmost end, said hopper rotatable on an axis parallel to the pivot axis of said key, said hopper abutting a fixed member of said manifold and rotatable by said abutment when said key is pressed downward by a player's finger;

a hammer pivotally supported in said manifold, said hammer pivot located behind said key pivot, the axes of hammer and key pivots being parallel;

a foot-like extension of said hammer located above said hopper, said extension in a location to receive an upward impetus when said hopper is raised by the pressing downward of said key, said impetus causing a hammer to be tossed in an upward arc of rotation; and a hopper rotatable clear of a path of contact with a foot-like extension of said hammer when said hopper is raised by the pressing downward of said key.

7. A means according to claim 4 comprising:

a key pivotally supported in a manifold, said key having a finger-operable member forward of its pivot and a spring attached behind its pivot;

a hammer pivotally supported in said manifold, said hammer having a hammer cam forward of its pivot, said hammer cam located above said spring; and a gap between said hammer cam and said spring that is widest when a key is in a released position and smallest when a key is pressed fully downward, the width of said gap determining a larger or smaller arc of upward rotation of said hammer when said key is pressed by a lesser or a greater distance, respectively, by a player's finger.

8. A means according to claim 5 comprising:

a hammer pivotally supported in said manifold, said hammer having a weighted striker attached at its rearmost end, said striker located over a musical string; and a musical string tuned to a note of the chromatic scale, playable by said striker following rotation of said hammer through a downward arc of rotation and bounce of said striker from said string to then repeat an upward arc of rotation.

9. An apparatus according to claim 1 further comprising means enabling a player to accurately sense the distance a key is pressed down, thus control by sense of touch the frequency of tremolo, said means comprising:

a key pivotally supported in a manifold, said key having a finger-operable member forward of its pivot, said member stopped at a lowest position by a coiled spring attached to a fixed member of said manifold, the compression of said spring being sensible to a player's finger; as well as a hopper pivotally connected at the rearmost end of said key, said hopper rotatable on an axis parallel to the pivot axis of said key, said hopper abutting a fixed member of said manifold and rotatable by said abutment when said key is pressed downward by a player's finger, said rotation producing compression of a second coiled spring, the compression of which being sensible to a player's finger.

10. A device that quits the motion of a hammer according to claim 1 comprising:

a hammer pivotally supported in said manifold, said hammer having a weighted striker attached at its rearmost end, said striker located over a musical string, and said hammer having a hammer cam extending forward of its pivot;

a key pivotally supported in a manifold, said key having a finger-operable member forward of its pivot and a key cam extending rearward of its pivot, said key cam located above said hammer cam;

said key cam in a lowest position when said finger-operable portion is released by a player's finger, said key cam in contact with said hammer cam preventing rotation of said striker onto said string and holding said striker a small distance over said string; and said key cam in a raised position when said finger-operable portion is pressed downward by a player's finger, said key cam not in contact with said hammer cam permitting rotation of said striker onto said string.

11. Tilted mounting of said keys according to claim 1 whereby finger-operable members of said keys that extend forward toward a player are tilted down by some angle such as 15 degrees from horizontal assisting more convenient fingering to a player when said instrument is held by a player at an upward tilt; and tilted mounting of said hammers according to claim 1 at some angle such as 15 degrees from horizontal enabling a player to decelerate the period of tremolo by tilting said instrument to bring said hammers off of the horizontal by an angle greater than 15 degrees, said hammers there acted upon by a lessened moment of gravity on weighted strikers at the rearmost ends of said hammers.

* * * * *